US007374434B1

(12) United States Patent
Huang

(10) Patent No.: US 7,374,434 B1
(45) Date of Patent: May 20, 2008

(54) OPEN TERMINAL CONNECTOR, METHOD OF FABRICATION OF SAME

(75) Inventor: Wen-Chin Huang, Taipei Hsien (TW)

(73) Assignee: Moxa Technologies Co., Ltd., Taipei Hsien (TW)

( * ) Notice: Subject to any disclaimer, the term of this patent is extended or adjusted under 35 U.S.C. 154(b) by 0 days.

(21) Appl. No.: 11/826,785

(22) Filed: Jul. 18, 2007

(51) Int. Cl.
*H01R 12/00* (2006.01)

(52) U.S. Cl. ..... 439/76.1

(58) Field of Classification Search ..... 439/76.1, 439/736, 607; 29/830, 850, 883
See application file for complete search history.

(56) References Cited

U.S. PATENT DOCUMENTS 5,646,827 A * 7/1997 Hirao et al. ..... 361/707
5,816,829 A * 10/1998 Chiang ..... 439/76.1
6,083,039 A * 7/2000 Finona ..... 439/493
6,162,093 A * 12/2000 Sudol et al. ..... 439/607
7,002,813 B2 * 2/2006 Bergmann et al. ..... 361/807

* cited by examiner

*Primary Examiner*—Phuong K Dinh
(74) *Attorney, Agent, or Firm*—Bacon & Thomas, PLLC

(57) ABSTRACT

An open terminal connector formed of a plug-in connector, a circuit board, a terminal block, baffles, an electrically insulative inner housing and an electrically insulative outer housing, in which the baffles stop the molten material from entering wiring holes of the terminal block during molding of the inner housing and the outer housing and reinforce the structural strength of the connector after molding of the inner housing and the outer housing, and the outer housing is directly injection-molded on all parts to prohibit the internal metal conducting terminals and the circuit board from direct contact with the outside air, allowing the connector to be used under a high humidity and/or critical temperature environment.

11 Claims, 10 Drawing Sheets

OPEN TERMINAL CONNECTOR, METHOD OF FABRICATION OF SAME

BACKGROUND OF THE INVENTION

1. Field of the Invention

The present invention relates to an electric connector and more particularly, to an open terminal connector, which has baffles provided at the rear, bottom and lateral sides of the terminal block to prohibit the molten material from entering the wiring holes of the terminal block during molding of electrically insulative inner and outer housings and to reinforce the structural strength of the connector, and which has the electrically insulative outer housing directly molded on the parts to prohibit the internal metal conducting terminals and the circuit board from direct contact with the outside air, allowing the connector to be used under a high humidity and/or critical temperature environment.

2. Description of the Related Art

Following fast development of communication technology, communication networks have also been well developed. LAN (Local Area Network) and WAN (Wide Area Network) are categorized subject to their scope and scale. A LAN connects network devices over a relatively short distance. A WAN is a geographically-dispersed collection of LANs. The Internet is the largest WAN, spanning the Earth.

Either in LAN or WAN, Ethernet has proven itself as a relatively inexpensive, reasonably fast, and very popular LAN technology. Ethernet cables (fiber optics or twisted pair) are limited in their reach, and these distances are insufficient to cover medium-sized and large network installations and therefore intermediary devices such as hubs, switches, routers, and etc., are used in Ethernet, allowing multiple cables to be joined and greater distances to be spanned. By means of the combination of Ethernet cables with hubs, switches and/or routers, an Ethernet networking allows transmission or control of data or instructions among different LANs, computers, and/or other devices such as surveillance systems, security systems, automation systems, etc.

Further, the network configuration of an industrial surveillance system, security system or auto-control network is based on peer-to-peer technology. Either in LAN or WAN, transmission interface means is necessary for connection between the local site and the remote site for local/remote control. Different transmission interfaces require different connection devices and different connection lines, and have different limitations on connection distance. For example, RS-485 can be used to communicate with remote devices at distances up to 4000 ft (1200 m) at speeds of up to 100 Kbps at this distance. Further, RS-485 is an ISI modle physical layer electrical specification of a two-wire half-duplex, multipoint serial connection. According to this specification, one polarity of voltage indicates a logic 1 level, the reverse polarity indicates logic 0. Except RS485, many other transmission interfaces can be used for data transmission among different departments, zones, or floors in a factory against electromagnetic interferences from the machinery or control terminal. For connection between different transmission interfaces at the local or remote site, a connector or adapter is required.

For the connection between different interfaces using different wires or having different pins, it is suggested to use a connector having open terminals or contacts. Conventional open terminal connectors or open contact connectors commonly use an electrically insulative outer housing formed of a top cover shell and a bottom cover shell to protect the terminal block. However, these open terminal connectors or open contact connectors are still not satisfactory in function because of the following drawbacks:

1. Because the electrically insulative housing is formed of a top cover shell and a bottom cover shell and the top and bottom cover shells are fastened together with internal or peripheral fastening members, the structural strength of the electrically insulative housing is not strong, and the electrically insulative housing tends to be damaged after several mounting and dismounting procedures or upon an accidental impact.

2. Because the top cover shell and bottom cover shell of the electrically insulative housing are simply capped on the connector body, the internal electrical devices are exposed to the outside air. When the connector is used under a high humidity or critical temperature environment, the circuits of the circuit board will be damaged soon, shortening the working life of the connector.

To keep conducting terminals exposed to the outside for quick connection and to have match with different achieve satisfy conversion between different Therefore, it is desirable to provide an open terminal connector that eliminates the aforesaid problems.

SUMMARY OF THE INVENTION

The present invention has been accomplished under the circumstances in view. It is therefore the main object of the present invention to provide an open terminal connector, which has the electrically insulative inner and the outer housings injection-molded on the parts thereof to prohibit the internal metal conducting terminals and the circuit board from direct contact with the outside air, for allowing the open terminal connector to be used under a critical working environment.

It is another object of the present invention to provide an open terminal connector, which has the electrically insulative outer housing directly molded on the terminal block so that electrically insulative outer housing protects the terminal block well and will not be forced apart from the terminal block upon an accidental impact.

It is still another object of the present invention to provide an open terminal connector, which uses baffles to stop the molten material from entering wiring holes of the terminal block during molding of the electrically insulative inner housing and the outer housing and to reinforce the structural strength of the connector after molding of the electrically insulative inner housing and the outer housing.

To achieve these and other objects of the present invention, the open terminal connector comprises a circuit board having a plurality of solder pins, a plug-in connector, which comprises a plurality of conducting terminals respectively electrically connected to the solder pins of the circuit board, and a plurality of mounting through holes, a terminal block, which comprises a plurality of conducting terminals respectively electrically connected to the solder pins of the circuit board, a plurality of wiring holes for receiving electrical wires, and a plurality of screw holes corresponding to the wiring holes for the mounting of holding down screws, a baffle set, which comprises a transverse baffle disposed adjacent to the rear side of the wiring holes of the terminal block, a bottom baffle bonded to a bottom side of the terminal block, and two lateral baffles disposed at two opposite lateral sides of the terminal block, an electrically insulative outer housing formed integral with and covered on the plug-in connector, the circuit board, the terminal block and the baffle set, and a plurality of mounting screws respectively mounted in the mounting through holes of the plug-in connector for securing the open terminal connector to an external electronic apparatus.

DETAILED DESCRIPTION OF THE PREFERRED EMBODIMENT

Figure 1:
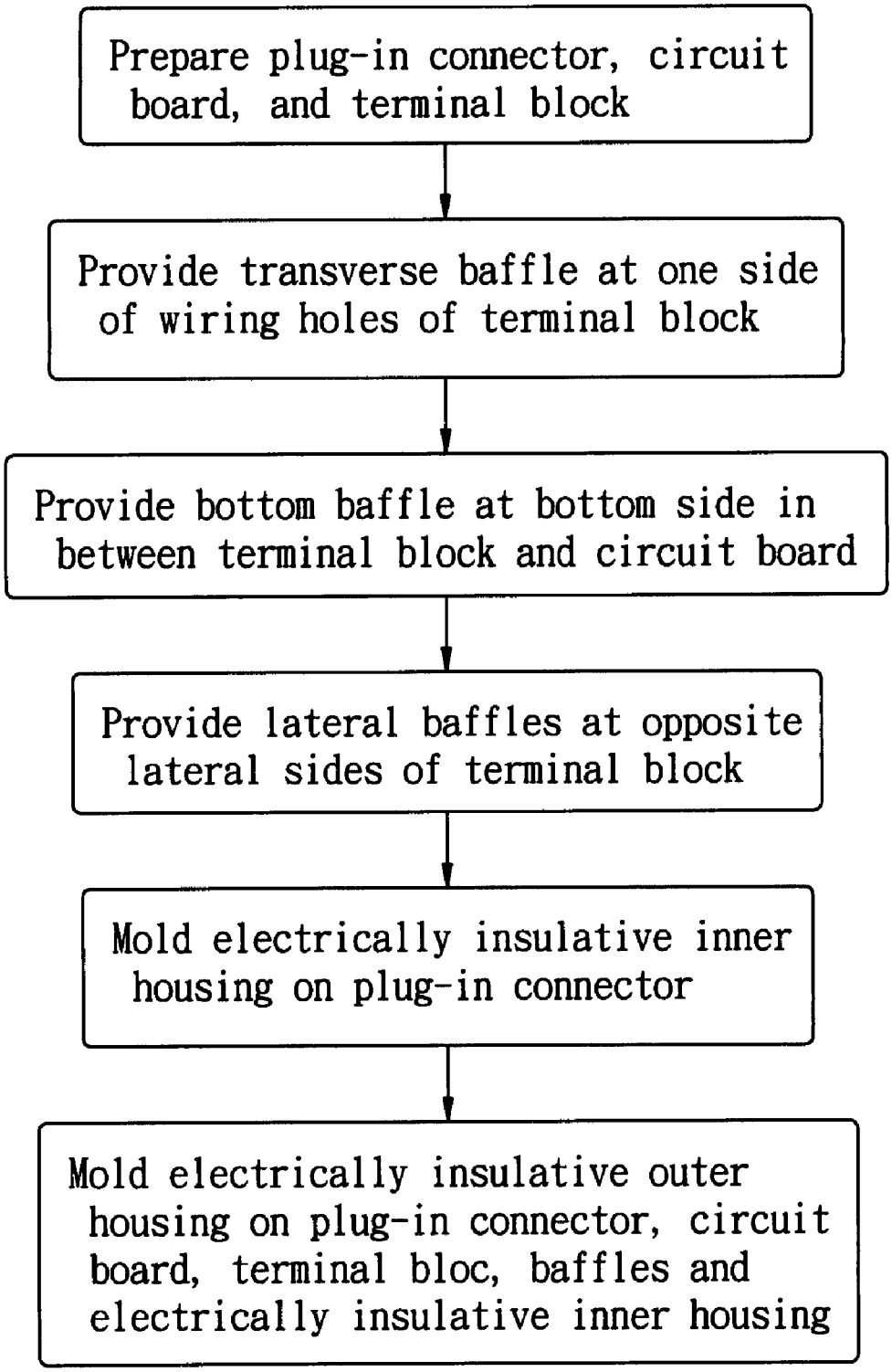
FIG. 1 is a flow chart showing the fabrication procedure of an open terminal connector according to the present invention.
Figure 2:
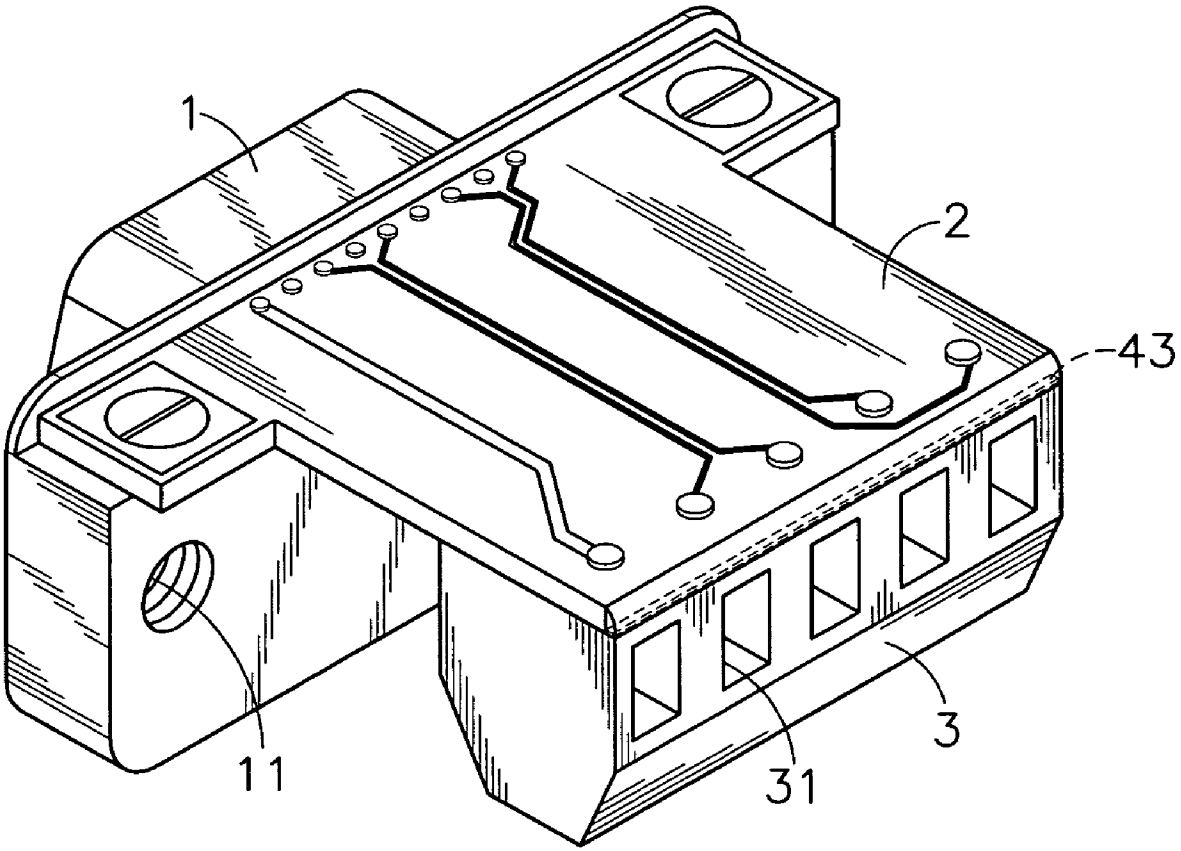
FIG. 2 is an oblique bottom view of an open terminal connector according to the present invention (before molding of the inner housing and the outer housing).
Figure 3:
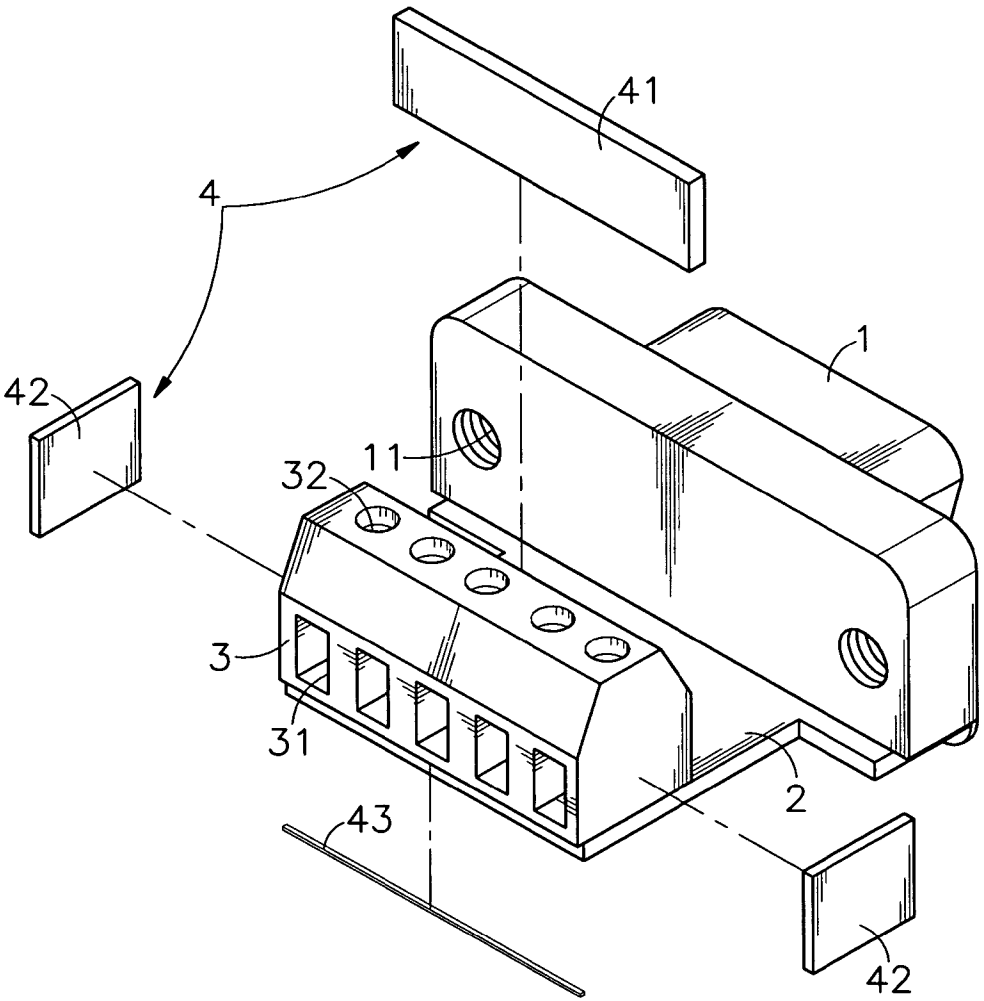
FIG. 3 is an exploded view of FIG. 2.
Figure 4:
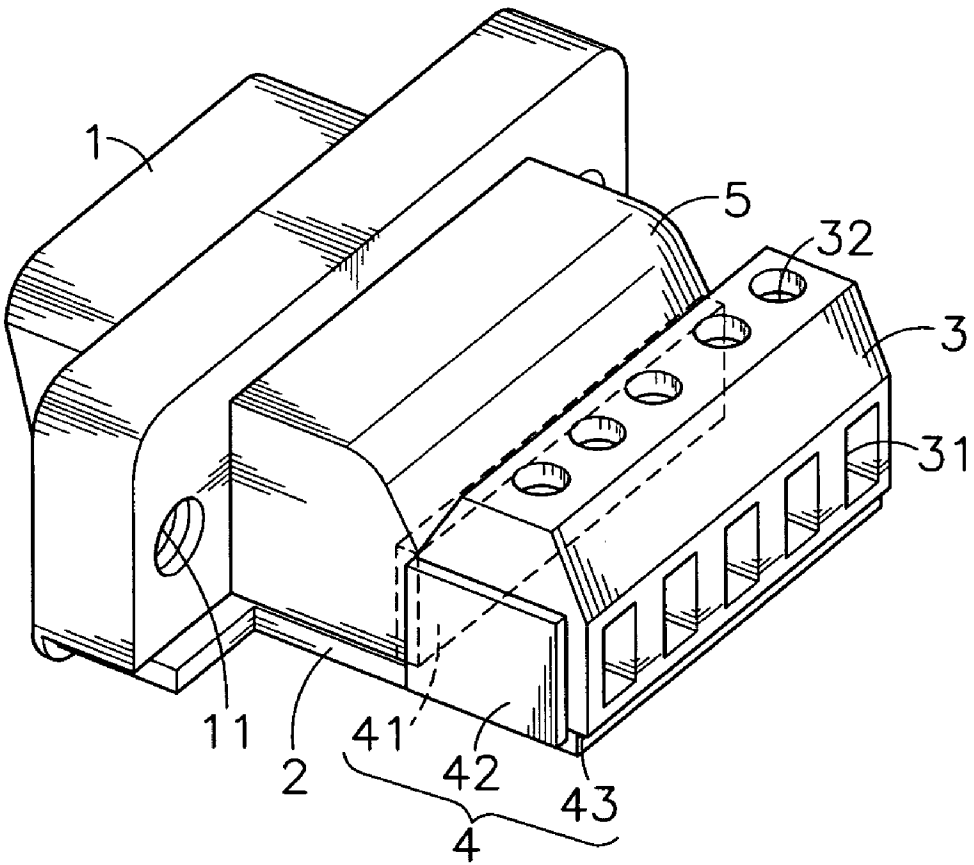
FIG. 4 is a perspective view of the open terminal connector according to the present invention (after molding of the inner housing and before molding of the outer housing).
Figure 5:
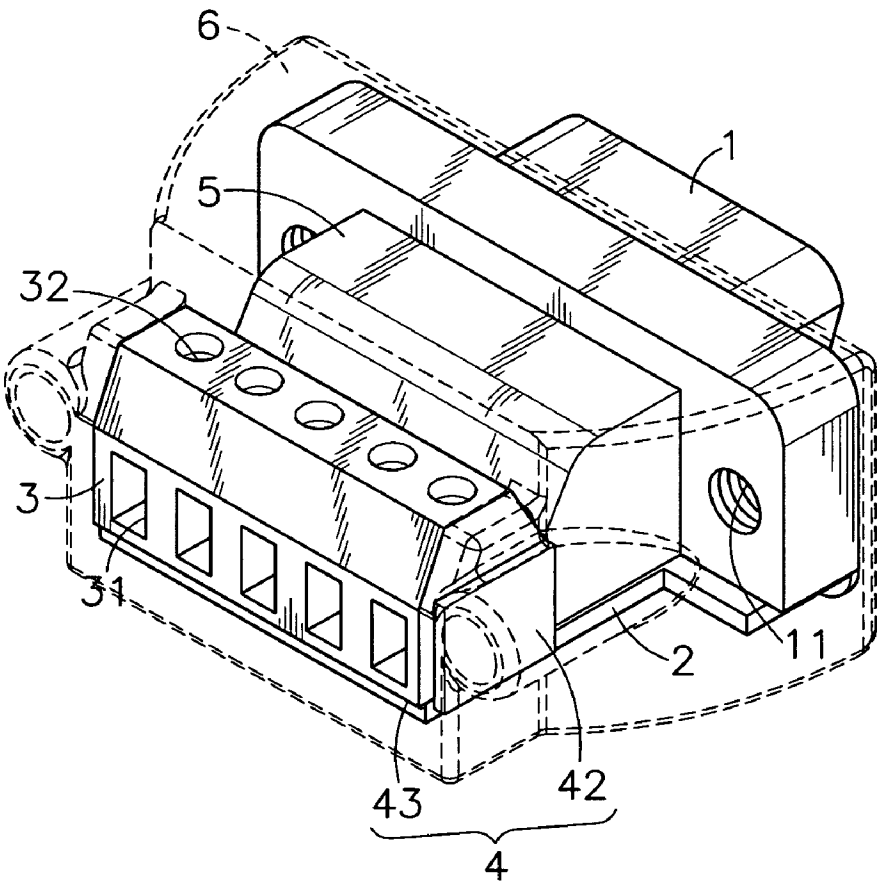
FIG. 5 is a perspective view of the open terminal connector according to the present invention (before installation of the mounting screw and the holding down screws).
Figure 6:
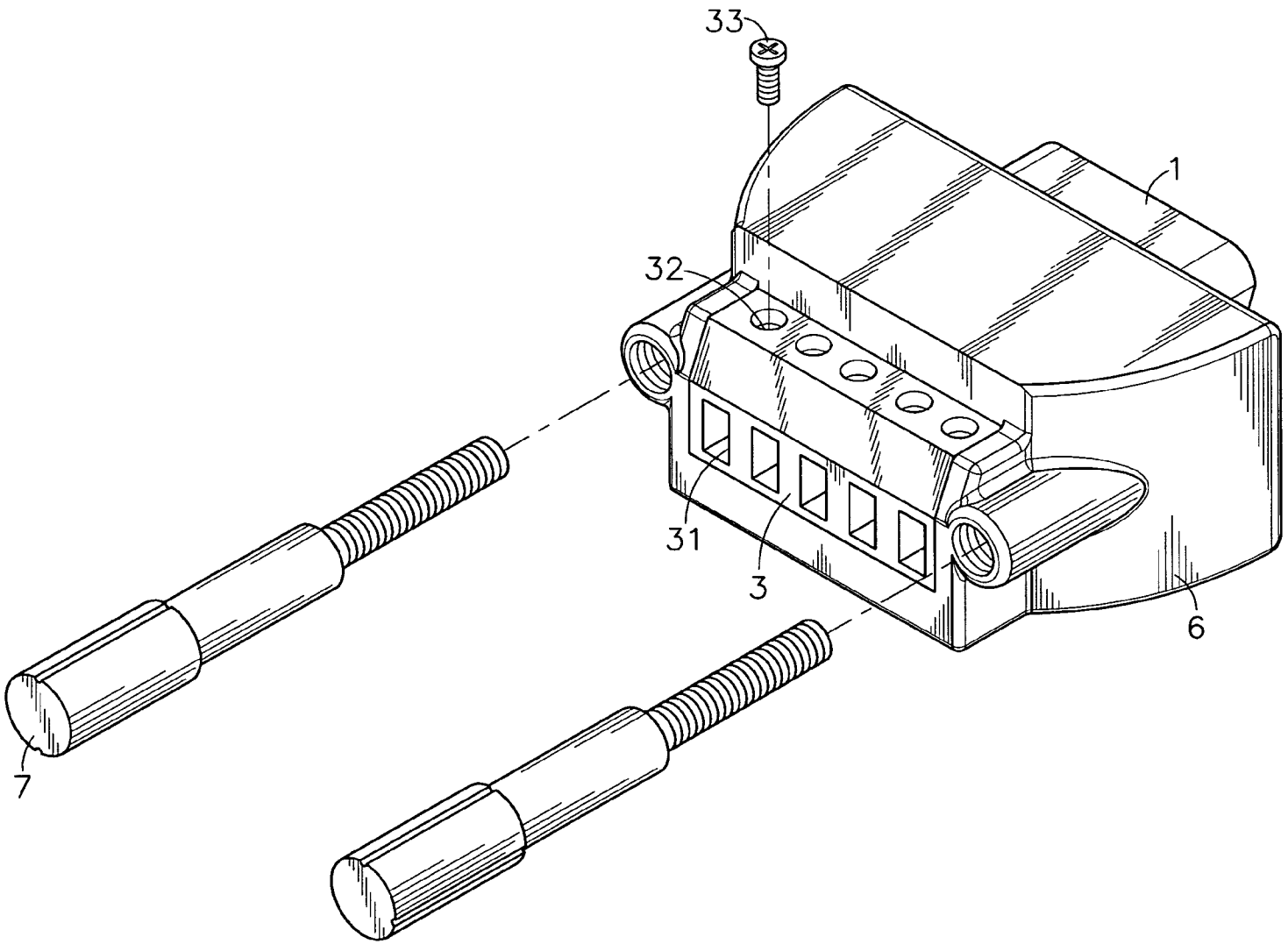
FIG. 6 is an exploded view of the open terminal connector according to the present invention.
Figure 7:
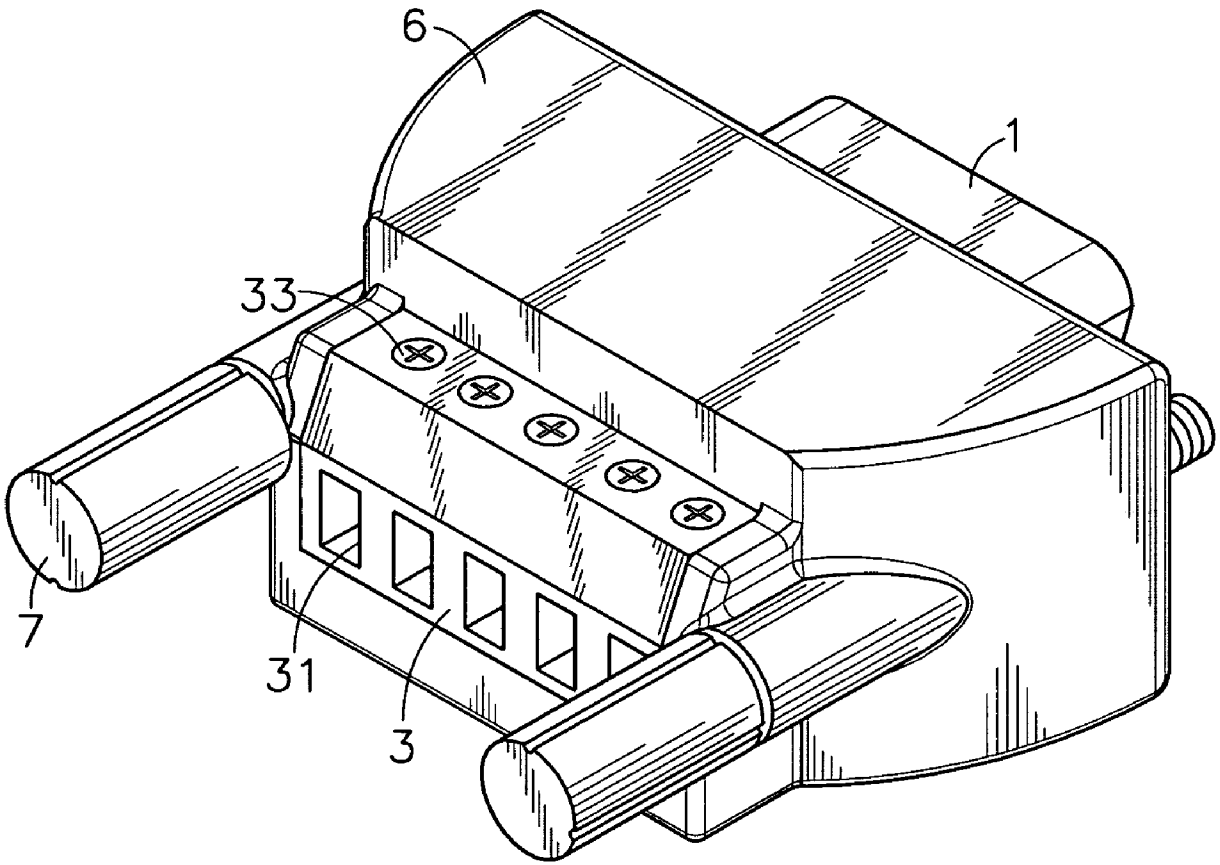
FIG. 7 is an elevational view of the open terminal connector after installation of the mounting screw and the holding down screws according to the present invention.

Referring to FIGS. 1 and 2, an open terminal connector fabrication method in accordance with the present invention comprises the steps of:

1. Prepare a plug-in connector 1, a circuit board 2 and a terminal block 3, and then electrically connect metal conducting terminals of the plug-in connector 1 to respectively solder pins of the circuit board 2 to provide an interface for electrical signal transmission, and then electrically connect the solder pins of the circuit board 2 to respective metal conducting terminals of the terminal block 3 so that the plug-in connector 1, the circuit board 2 and the terminal block 3 are electrically connected together (see FIG. 2);

2. Install a transverse baffle 41 in the back side of the plug-in connector 1 adjacent to wiring holes 31 of the terminal block 3 by means of a packaging process such as spot adhesive (see FIG. 3);

3. Install a bottom baffle 43 in the connection area between the terminal block 3 and the circuit board 2 by means of a packaging process such as spot adhesive (see FIG. 3);

4. Install two lateral baffles 42 in two opposite lateral sides of the terminal block 3 by means of a packaging process such as spot adhesive (see FIG. 3);

5. Form an electrically insulative inner housing 5 on the plug-in connector 1 by injection molding (see FIG. 4) wherein the transverse baffle 41 stops molten material from entering the wiring holes 31 during the molding of the inner housing 5 and the lateral baffles 42 reinforce the structural strength of the whole open terminal connector after the molding of the inner housing 5;

6. Form an electrically insulative outer housing 6 to cover the plug-in connector 1, the circuit board 2, the terminal block 3, the baffle set 4 and the inner housing 5 by means of injection molding (see FIG. 5), letting the front side of the metal conducting terminals of the plug-in connector 1 and the front side of the wiring holes 31 (for twist wires or wire materials) and top side of receiving (screw) holes 32 (for holding down screws) of the terminal block 3 be exposed to the outside of the outer housing 6, wherein the baffle set 4 (the transverse baffle 41, lateral baffles 42 and bottom baffle 43) stop molten material from entering the wiring holes 31 during the molding of the outer housing 6 and reinforce the structural strength of the during the molding of the outer housing 6; and 7. Install a respective mounting screw 7 in two mounting through holes 11 of the plug-in connector 1, and the finished open terminal connector is thus obtained (see FIGS. 6 and 7).

Figure 8:
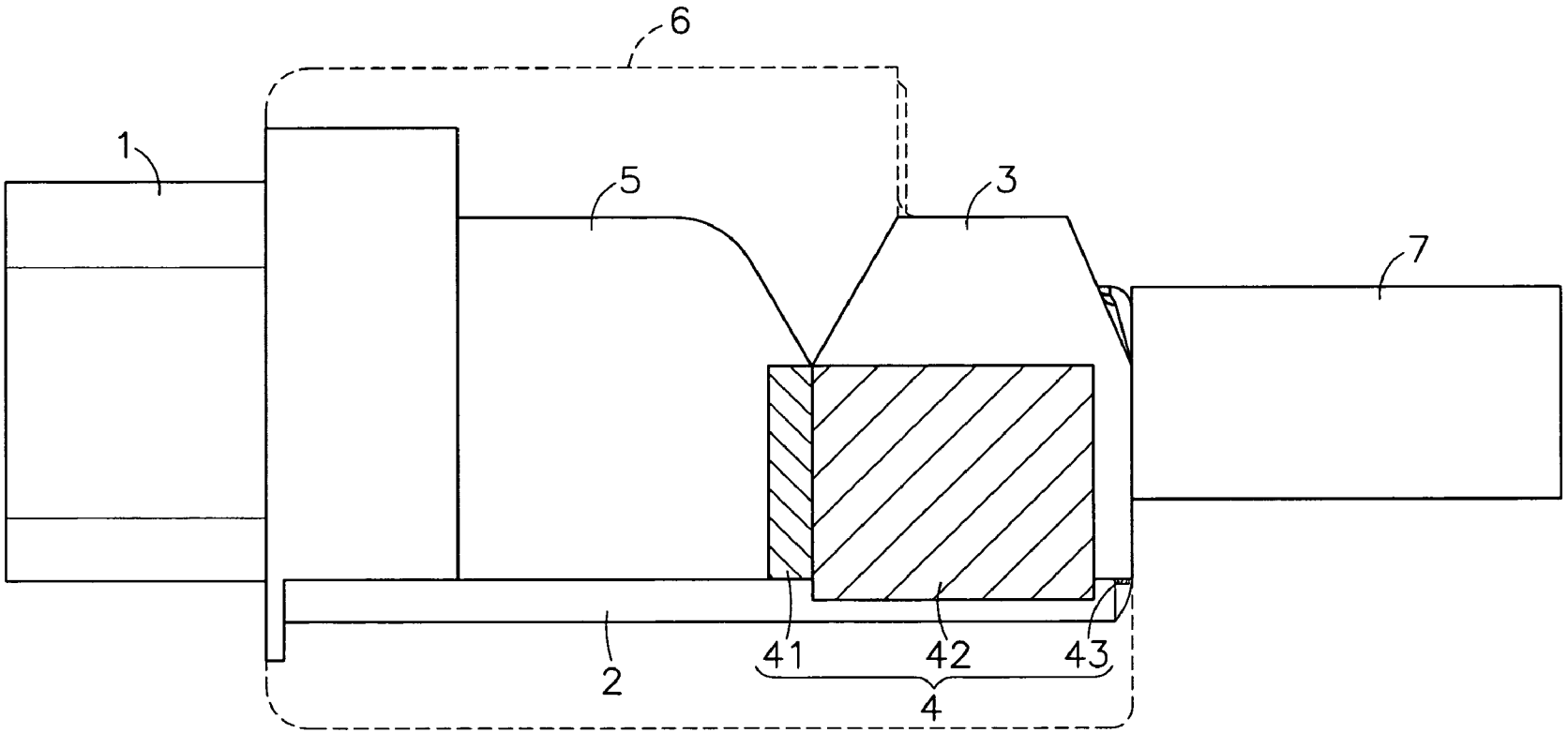
FIG. 8 is a sectional side plain view of the open terminal connector according to the present invention.
Figure 9:
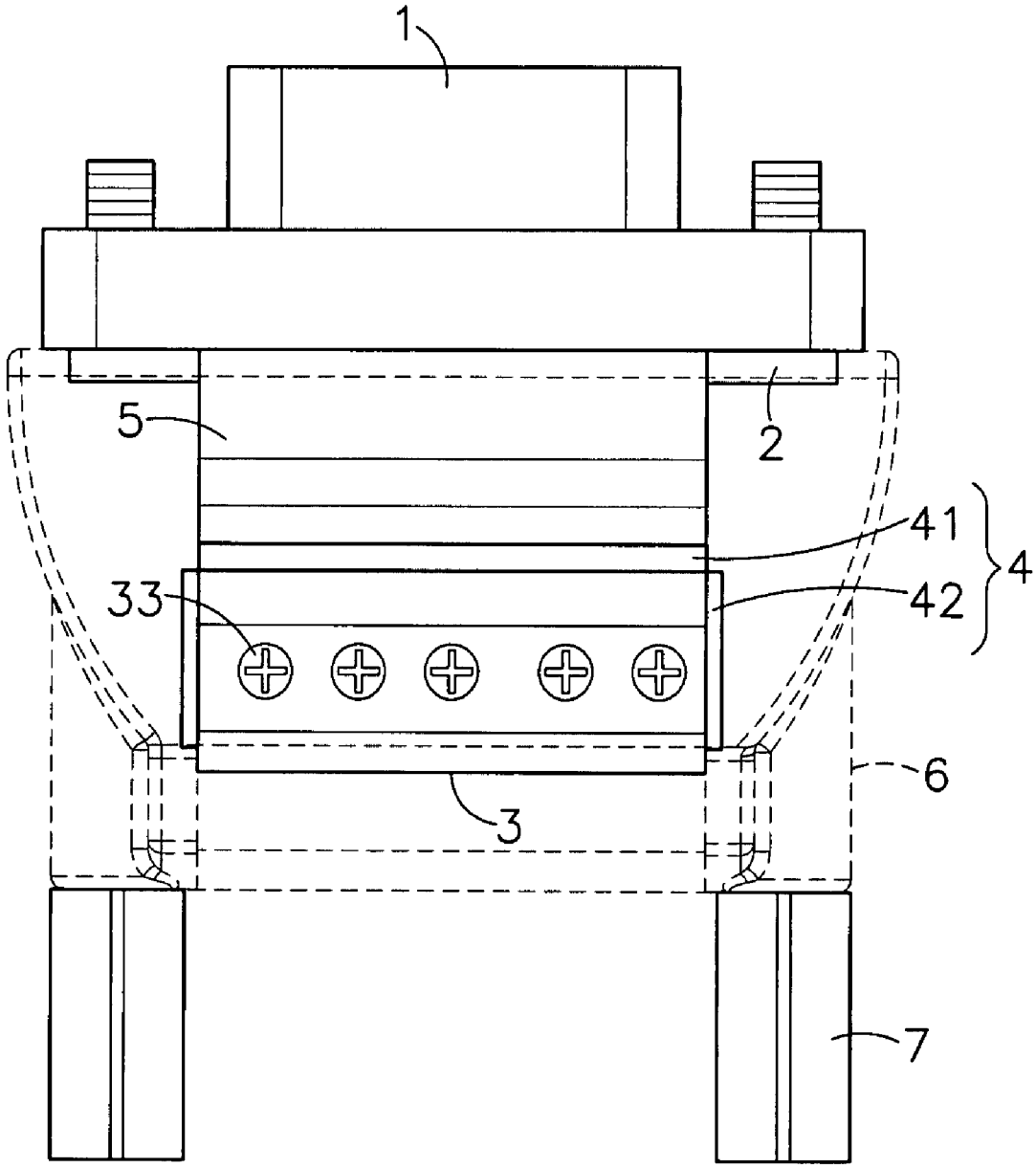
FIG. 9 is a top plain view of the open terminal connector according to the present invention.

An open terminal connector made according to the aforesaid fabrication method is comprised of a plug-in connector 1, a circuit board 2, a terminal block 3, a baffle set 4, an electrically insulative inner housing 5 and an electrically insulative outer housing 6. The plug-in connector 1 comprises a plurality of metal conducting terminals respectively electrically connected to respective solder pins of the circuit board 2. The solder pins of the circuit board 2 are respectively electrically connected to respective metal conducting terminals of the terminal blocks 3. Therefore, the metal conducting terminals of the plug-in connector 1, the solder pins of the circuit board 2 and the metal conducting terminals of the terminal block 3 are respectively electrically connected. The terminal block 3 comprises a plurality of wiring holes 31 and screw holes 32 respectively disposed in communication with the wiring holes 31. Each wiring hole 31 forms with the associating screw hole 32 a respective through hole extending through two sides of the terminal block 3. The baffle set 4 is comprised of one transverse baffle 41, two lateral baffles 42 and one bottom baffle 43. As shown in FIGS. 8 and 9, the baffle set 4 protects the wiring holes 31 against overflow of the molten material during molding of the inner housing 5 and the outer housing 6, and reinforces the structural strength of the open terminal connector. After molding of the outer housing 6, mounting screws 7 and holding down screws 33 are respectively mounted in mounting through holes 11 of the plug-in connector 1 and the screw holes 31 of the terminal block 3.

Figure 4A:
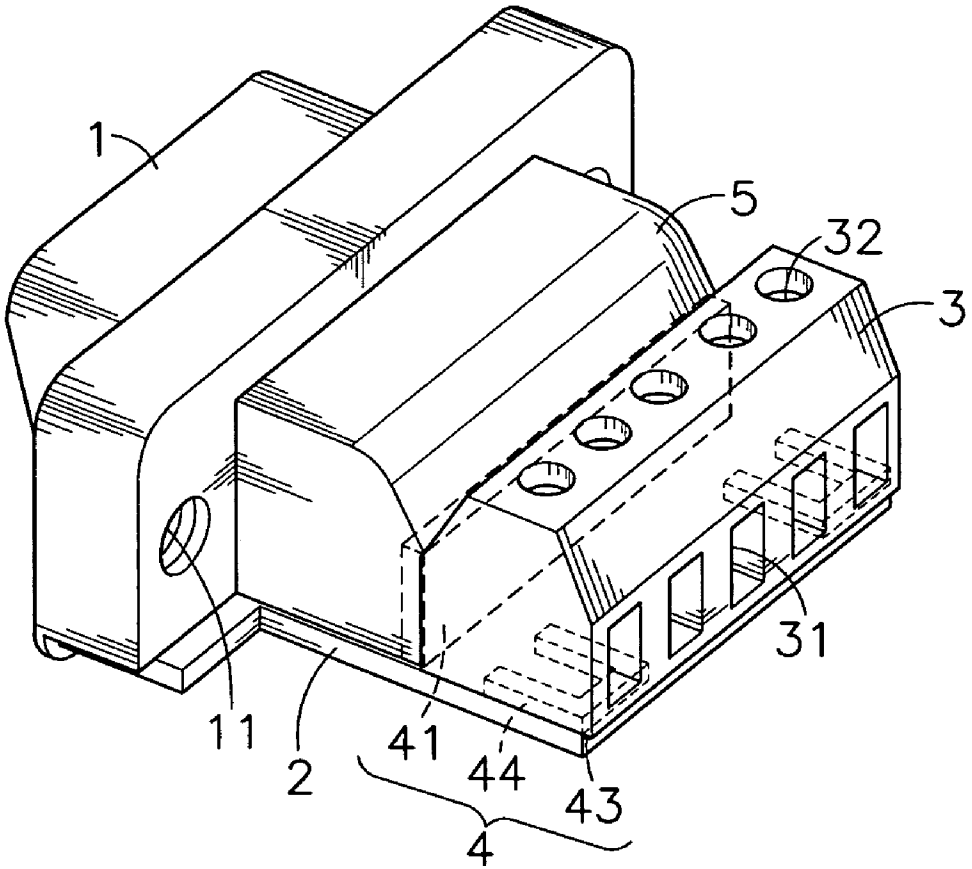
FIG. 4A corresponds to FIG. 4, showing supplementary lateral baffles bonded to the terminal block.

To enhance the structural strength of the terminal block 3, two supplementary lateral baffles 44 may be bonded to the two opposite lateral sides of the terminal block 3 before connection of the terminal block 3 and the circuit board 2 (see FIG. 4A).

For use in local-remote electronic apparatus connection, the plug-in connector 1 can be a male or female connector and used as an electronic apparatus connection interface. For use in a differential transmission type RS-422/485 interface, twist-wires are suggested for the differential signal, and the two pairs of signals TXD+/− and RXD+/− are defined to be in the successive positions convenient for wiring of twist-wires.

The lateral baffles 42 shown in the annexed drawings are simple an example of the present invention. Except rectangular shape, the lateral baffles 42 can be made L-shape, U-shape or any other shape. Other similar means capable of sealing the gap between the terminal block 3 and the circuit board 2 may be used to substitute the baffles.

When compared to the conventional techniques, the open terminal connector of the present invention has the following features and advantages:

1. By means of the application of injection molding technology, the outer housing 6 effectively protects the terminal block 3 and will not be forced away from the body of the open terminal connector upon an accidental impact. Therefore, the invention eliminates the drawback of the combination housing of the prior art design that is formed of a top cover shell and a bottom cover shell and secured in place with fastening means and that tends to be damaged upon an accidental impact after several mounting and dismounting procedures.

2. By means of injection molding to form the integrated outer housing 6 that covers the whole body of the open terminal connector, the internal metal conducting terminals and the circuit board are prohibited from direction contact with outside air. Therefore, the open terminal connector of the present invention is suitable for use under a high humidity and/or critical temperature environment. The integrated outer housing 6 well protects the electrical components of the circuit board, prolonging the working life of the connector.

3. Because the wiring holes 31 and the screw holes 32 are exposed to the outside of the integrated outer housing 6, the user can insert twist wires in the wiring holes 31 and install holding down screws 33 in the screw holes 32 to affix the inserted twist wires in position conveniently.

4. The baffle set 4 (transverse baffle 41, lateral baffles 42, and bottom baffle 43) prohibits the applied molten material from entering the wiring holes 31 during molding of the inner housing 5 and the outer housing 6, and reinforces the structural strength of the open terminal connector for allowing the open terminal connector to be used under a critical working environment.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. An open terminal connector comprising:

a circuit board, said circuit board comprising a plurality of solder pins;

a plug-in connector, said plug-in connector comprising a plurality of conducting terminals respectively electrically connected to the solder pins of said circuit board, and a plurality of mounting through holes;

a terminal block, said terminal block comprising a plurality of conducting terminals respectively electrically connected to the solder pins of said circuit board, a plurality of wiring holes for receiving electrical wires, and a plurality of screw holes corresponding to said wiring holes for the mounting of holding down screws;

a baffle set, said baffle set comprising a transverse baffle disposed adjacent to a rear side of said wiring holes of said terminal block, a bottom baffle bonded to a bottom side of said terminal block, and two lateral baffles disposed at two opposite lateral sides of said terminal block;

an electrically insulative outer housing formed integral with and covered on said plug-in connector, said circuit board, said terminal block and said baffle set; and a plurality of mounting screws respectively mounted in said mounting through holes of said plug-in connector for securing the open terminal connector to an external electronic apparatus.

2. The open terminal connector as claimed in claim 1, further comprising an electrically insulative inner housing embedded in said electrically insulative outer housing and covering a part of said circuit board, a part of said plug-in connector and said transverse baffle.

3. The open terminal connector as claimed in claim 1, wherein said wiring holes are respectively connected to said screw holes and exposed to the outside of said electrically insulative outer housing.

4. The open terminal connector as claimed in claim 1, wherein said two lateral baffles are respectively attached to sides of said terminal block.

5. The open terminal connector as claimed in claim 1, wherein said plug-in connector is a male connector.

6. The open terminal connector as claimed in claim 1, wherein said plug-in connector is a female connector.

7. The open terminal connector as claimed in claim 1, which has TXD+/− and RXD+/− signal pins arranged in a successive manner.

8. The open terminal connector as claimed in claim 1, wherein said lateral baffles are one of rectangular shape, L-shape and U-shape.

9. An open terminal connector fabrication method comprising the steps of:

a) preparing a plug-in connector, a circuit board and a terminal block, and electrically connecting said plug-in connector and said terminal block to said circuit board;

b) installing a transverse baffle in said terminal block at one side of wiring holes of said terminal block;

c) mounting a bottom baffle in a bottom side in between said terminal block and said circuit board;

d) mounting two lateral baffles in two opposite lateral sides of said terminal block;

e) injection-molding an electrically insulative inner housing on said plug-in terminal; and f) injection-molding an electrically insulative outer housing over said plug-in connector, said circuit board, said terminal block, said transverse baffle, said lateral baffles, said bottom baffle and said electrically insulative inner housing.

10. The open terminal connector as claimed in claim 9, wherein said lateral baffles are attached to sides of said terminal block.

11. The open terminal connector as claimed in claim 9, further comprising the step of mounting a plurality of mounting screws in respective mounting through holes of said plug-in connector.

* * * * *